United States Patent [19]

Wallo

[11] 4,072,386

[45] Feb. 7, 1978

[54] SOLID SHELL PHONOCONNECTORS

[75] Inventor: William H. Wallo, Clearwater, Fla.

[73] Assignee: Perfection Enterprises, Inc., Chicago, Ill.

[21] Appl. No.: 547,544

[22] Filed: Feb. 6, 1975

[51] Int. Cl.[2] ..... H01R 13/54

[52] U.S. Cl. ..... 339/91 R; 339/177 R

[58] Field of Search ..... 339/75 A, 91 P, 253 R, 339/177 R, 177 E; 285/415, 321

[56] References Cited

U.S. PATENT DOCUMENTS

| | | | |
|---|---|---|---|
| 2,761,111 | 8/1956 | Klosterman | 339/91 |
| 3,206,540 | 9/1965 | Cohen | 339/91 P |
| 3,279,835 | 10/1966 | Krohm | 285/321 |
| 3,540,760 | 11/1970 | Miller | 285/321 |
| 3,793,610 | 2/1974 | Brishka | 339/74 |
| 3,858,156 | 12/1974 | Zarro | 339/177 |

*Primary Examiner*—Mark S. Bicks

*Attorney, Agent, or Firm*—Hill, Gross, Simpson, Van Santen, Steadman, Chiara & Simpson

[57] ABSTRACT

Superior press-on retention, improved electrical contact and elimination of radio frequency leakage are attained in phonoconnectors by having the shell of the pin plug assembly as well as the shell of the receptacle solid. Internal clutch means in the form of an expansile spring ring carried by the phonoplug shell effectively grips and retains the phonoplug assembly in mechanically as well as electrically coupled engagement with a mating phonoreceptacle shell.

14 Claims, 7 Drawing Figures

Fig. 1
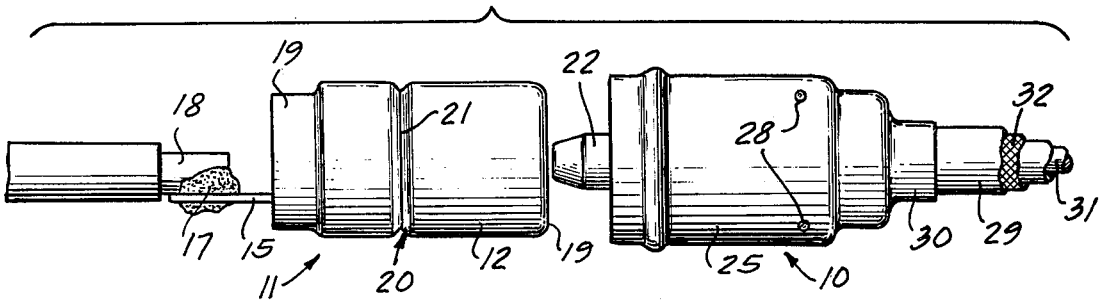
Fig. 2
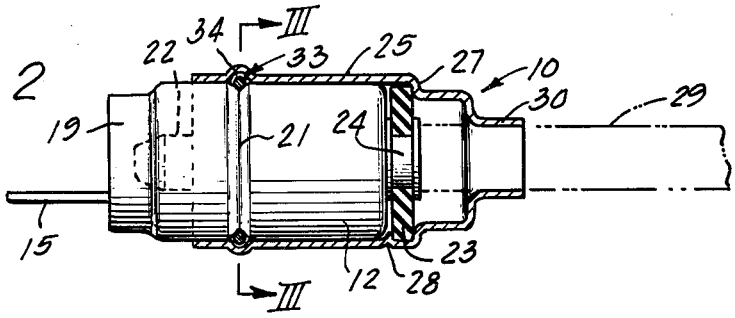
Fig. 3
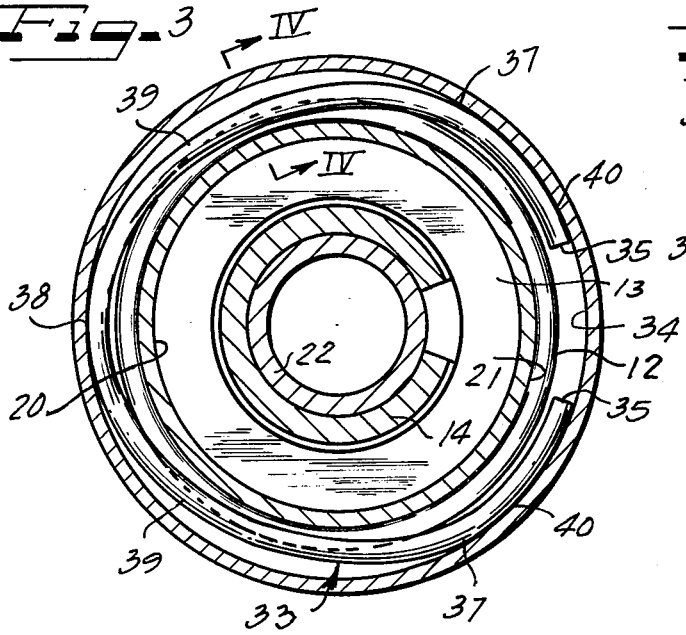
Fig. 5
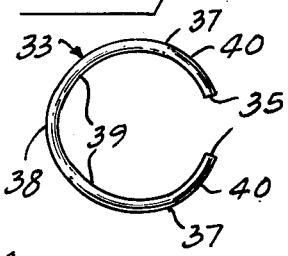
Fig. 6
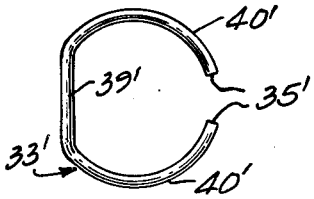
Fig. 7
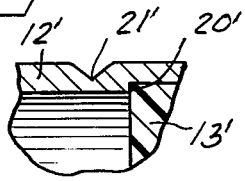
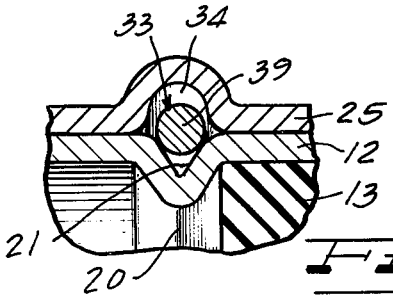
Fig. 4

SOLID SHELL PHONOCONNECTORS

This invention relates in general to separable electrical connectors, and is more particularly concerned with improvements in electrical couplings commonly referred to as phonoconnectors.

As is well known in the art, phonoconnectors are widely employed in effecting electrical couplings in television, stereo and high fidelty phonograph apparatus.

An important advantage accruing from use of phonoconnectors resides in that low cost, convenient means are provided for connecting two circuits together, or two pieces of apparatus, without requiring a soldered connection. Several problems have been encountered with conventional forms of phonoconnectors. More specifically, the pin plug shells consisting of a plurality of tulip tabs or fingers formed by slotting the shells, rely for retention upon inward crimping of the tab fingers to a diameter slightly smaller than the outside diameter of the phonojack receptacle shells. Due to inherent variables in the metal from which the pin plug shells are made, it is virtually impossible to maintain a uniform tension of the finger tabs. If the pin plug shells are cocked slightly when coupling with the receptacles, the tabs may become deformed and retention is correspondingly diminished. Experience has shown that retention quality diminishes with each separation and recoupling. There is frequent lack of contact efficiency between the finger tabs because in any event they only make contact at their tips with the phonojack shell, and if any one or more of the tabs is distorted or deformed it may not make contact at all. Since the inside diameter of the pin plug shell inwardly beyond the contact points of the tabs is somewhat larger than that of mating receptacle shell, relative rocking action may occur, resulting in intermittence in electrical contact. This has caused some users, such as television manufacturers, to solder the cable-connected pin plug shell assembly to the phonojack receptacle on the chassis to prevent accidental disassembly as well as to avoid intermittence. In addition, radio frequency leakage occurs through the inner ends of the slots, which are generally four in number, between the finger tabs, especially in respect to the shorter forms of the tulip style pin plug shells.

An important object of the present invention is to overcome the foregoing and other disadvantages, deficiencies, inefficiencies, shortcomings and problems in electrical couplings, more particularly phonoconnectors, and to provide new and improved solid shell phonoconnectors and coupling means therefor.

Another object of the invention is to provide new and improved coupling clutch means for phonoconnectors.

A further object of the invention is to provide a new and improved method of and means for efficient coupling of phonoconnector pin plugs with the shells of complementary receptacles.

Still another object of the invention is to provide superior electrical contact between the mating shells of electrical couplings such as phonoconnectors.

Yet another object of the invention is to eliminate radio frequency leakage from phonoconnectors.

A still further object of the invention is to provide a new and improved method of and means for frictionally coupling a phonoconnector pin plug assembly with a phonoreceptacle.

According to features of the invention, a phonoconnector pin plug assembly for coupling with a phonoreceptacle has an electrically conductive pin plug and an electrically conductive socket shell in electrically insulated concentric relation thereabout, the shell having a solid tubular wall with an inner diameter to receive a phonoreceptacle shell in sliding fit. An electrically conductive spring wire resilient split out-of-round clutch ring is seated in an annular groove defined by a radially outward bulge in the pin plug assembly socket shell and has clutching area in normally inwardly projecting relation from the inner diameter of the shell wall and adapted to retainingly grip a mating phonoreceptacle shell and thrust it eccentrically into firm electric contact with the socket shell wall.

According to additional features of the invention, the clutch means comprise a split clutch ring carried within a groove in the phonoplug shell wall.

According to further features of the invention, the clutch means are adapted to provide a strain separable interlock with recessed interlock means provided on a mating receptacle shell.

Other objects, features and advantages of the invention will be readily apparent from the following description of a preferred embodiment thereof, taken in conjunction with the accompanying drawings although variations and modifications may be effected without departing from the spirit and scope of the novel concepts embodied in the disclosure, and in which:

FIG. 1 is a side elevational view of a phonoconnector embodying features of the invention, and showing the pin plug and receptacle assemblies in separated aligned relation;

FIG. 2 is a sectional elevational view showing the phonoconnector assemblies coupled in mated relation;

FIG. 3 is an enlarged sectional illustrative view taken substantially along the line III—III of FIG. 2;

FIG. 4 is a substantially enlarged fragmentary sectional detail view taken substantially along the line IV—IV of FIG. 3;

FIG. 5 is a plan view of a clutch spring for the device;

FIG. 6 shows a modification of the clutch spring; and

FIG. 7 is a fragmentary enlarged sectional detail view showing a modification of the receptacle shell.

Phonoconnectors of the type with which the present invention is concerned comprise a pin plug assembly 10 (FIGS. 1 and 2) constructed and arranged to mate with a jack or receptacle assembly 11. Component elements of the receptacle assembly 11 comprise a tubular shell 12 supporting, by means of dielectric insulation sleeve 13 (FIG. 3), a split sleeve receptacle socket 14 having a rearwardly extending solder lug terminal 15 for electrical attachment thereto, as by means of solder 17, of an electrical wire or cable 18.

On its receiving or front end, that is the end opposite the solder lug 15, the shell is turned inwardly as indicated at 19 and retains the adjacent end of the dielectric sleeve 13, the opposite end of which is retained by means of an annular rib 20 indented in the wall of the shell 12 at a suitable intermediate point and defining an outwardly opening recessed annular groove 21. On its rear end, the shell 12 has a reduced diameter collar flange 19 for electrically grounding connection to a chassis component or the like.

Referring to the pin plug assembly 10, it comprises an electrically conductive elongated pin plug 22 dimensioned to be received in coaxial electrically connected frictional fit relation within the socket sleeve 14. This pin plug 22 may be a solid or hollow tubular construction, and is mounted concentrically on a dielectric mounting ring disk 23 (FIG. 2) by means of a crimped base 24. The mounting disk 23 supports the pin 22 in insulated spaced concentric relation within an electrically conductive shell 25 by which the pin plug assembly 10 is maintained in coupled relation with the phonojack receptacle 11. Means for retaining the insulating and mounting disk 23 in position within the shell 25 comprise an annular shoulder 27 formed on the shell 25 spaced a suitable distance from its mouth end and on which the disk 23 is seated. For retaining the disk 23 on the shoulder 27, a circumferentially spaced series of locking indents 28 may be formed as by deforming the material of the shell 25 in suitably spaced relation to the shoulder 27 and into opposing relation to the margin of the disk 23 which is thereby held on the seat 27. In a suitable arrangement three or four of the indents 28 located at equal circumferential intervals has been found satisfactory. As thus mounted, the plug pin 22 is adapted to be electrically connected with an externally insulated electrical cable 29 inserted into a reduced diameter end portion 30 of the shell 25. An end portion of an electrical lead 31 of the cable 29 extends into and is secured or at least electrically connected as by soldering to the base portion 24 of the pin 22, with an armor sheath 32 in electrically grounded connection with the shell 25. Thereby, when the phonoplug assembly pin is coupled with the phonojack assembly 11, a suitable electrical connection is effected between the cable leads 18 and 31, and a grounding connection with the chassis is effected through the coupled shells 12 and 25.

According to the present invention, the coupling shell 25 is provided as a solid, unslotted tubular member which may be drawn from suitable sheet material such as brass or steel. In a typical phonoconnector size, the main body portion of the shell 25 between its mouth end and the shoulder 27 may be about ½ inch long with a material gauge of 0.014–0.016. As a result of drawing, the material of the shell 25 is hardened and fairly stiff. Principal inside diameter of the shell wall 25 should be calculated to provide a free sliding fit with the receptacle shell 12 received therein. For example, there may be about 0.005 oversize differential in the inside diameter of the shell 25 relative to the outside diameter of the shell 12. In any event, the respective diameters of the shells 12 and 25 are preferably conformable to industry standards so that the pin plug assembly 10 can be interchangeably assembled with standard receptacle assemblies that may be encountered in the field, and the receptacle assembly 11 is preferably dimensioned to be interchangeably coupled with standard pin plug assemblies that may be encountered in the field.

According to the present invention, the pin plug assembly 10 is provided with new and improved clutch means for effecting retaining gripping engagement with the received receptacle assembly to maintain an effective, efficient coupled relationship both mechanically and electrically. In a preferred form, the clutch means comprise a friction device 33 (FIGS. 2–6) in the form of an out-of-round spring wire resilient split, ring 33 dimensioned to be carried within the shell 25 in an inwardly opening annular groove 34 defined by a radially outwardly projecting annular bulge formed in the drawn one piece thin sheet metal wall of the socket shell 25. The groove 34 is spaced from the open end of the shell 25 a limited distance so that there is an annular lead in length of the cylindrical wall of the socket shell between the open mouth end and the groove 34, and a substantial length of the wall of the shell 25 extends from the groove 34 inwardly for receiving the receptacle shell 12 slidably. For improved carrying of the ring 33, the groove 34 is of just slightly greater depth and width than the diameter of the wire cross section of the ring. For example, where the wire cross section diameter is 0.024 to 0.026 inch, the internal diameter of the groove 34 may be about 0.026 to 0.028 inch. Thereby, all portion of the ring 33 which are received within the groove 34 clear the outer perimeter of the shell 12 and free from interference with sliding reception of the receptacle shell 12 when a coupling of the pin plug assembly 10 and the receptacle assembly 11 is effected. However, an out of round configuration of the ring 33, as best seen in FIG. 5, assures that as seated in the groove 34, not only is the ring thoroughly retained in the groove against displacement therefrom in the normal usage of the device, but clutching area of the ring will effect a strong retaining gripping engagement with the perimeter of the shell 12 to maintain the coupled relationship of the assemblies and assure a thorough electrical connection between the shells 25 and 12.

In one preferred form, the clutch ring 33 has its opposite ends 35 spaced apart, and the circumference of the ring is provided with an out of round configuration wherein a plurality of arcuate shoulders are provided comprising outwardly bowed respective shoulders 37 adjacent to the ends 35, and an intermediate outwardly bowed shoulder 38 substantially midway between the shoulders 37, with intervening inwardly biased clutching areas 39 which are on a larger radius than the radius of the shoulders 37 and 38. As will be observed, this configuration effects a slight elongation of the generally C-shaped ring along a central axis extending between the ends 35. In addition, the areas 40 of the ring 33 between the ends 35 and the shoulders 37 are desirably formed on a radius of curvature which matches the radius of curvature of the circumferential diameter of the clutch groove 34 in the socket shell 25. In a typical example where the inside diameter of the shell 25 is about 0.333 to 0.335 inch, the dimension between the outside peak of the shoulders 37 may be about 0.375 inch, and the dimension between the peak of the shoulder 38 and a projection of the outside radius of the areas 40 across the gap between the ends 35 may be about 0.385 inch. This provides desirable differential oversize in the overall ring diameter to assure full seated retention of the ring in the groove 34 against unintended displacement from the groove in use.

Assembly of the ring 33 within the groove 34 is easily effected by compressing the ring and inserting it through the mouth of the socket shell 25 until the ring registers with the groove 34 and is permitted to expand into the groove. Thereupon, the inherent stiff resilience of the spring metal of the ring causes it to expand into the groove 34, the shoulders 37 and 38 and the areas 40 bottoming in the groove. By having the peaks of the shoulders 37 spaced toward the tips 35 from a median, transverse plane through the axis of the ring, there is a desirable cooperative expansion thrust component generated a on engagement of the shoulders 37 within the groove 34 toward the shoulder 38, causing it to bottom firmly within the groove 34 and correspondingly maintaining a component of thrust toward each of the shoulders 37 causing them to bottom firmly in the groove 34 and also maintaining the areas 40 of the ring bottomed in the groove 34, as best visualized in FIG. 3. This has a beneficial effect in maintaining the ends 35 within the groove and preferably clear within the inside diameter of the body portion of the shell 25 so that when assemblying the phonoplug assembly 10 with the phonojack receptacle 11, the ends 35 will avoid contact with the surface of the shell 12 and thus avoid scoring it. However, the clutching areas 39 will protrude from the groove 34 sufficiently to effect non-abrasive frictional gripping engagement with the surface of the shell 12. Thus, when the phonoplug assembly 10 and the phonojack assembly 11 are brought into coaxial assembly, the pin plug 22 leads into the mouth of the receptacle socket 14 and the front end of the shell 12 enters into the mouth end of the shell 25 until the turned end 19 encounters the clutch areas 39 camming thereagainst and as permitted by the resilience of the ring 33 spreading the cam areas 39 against resilient frictional clutch resistance thereof in response to relative axial assembly force applied to the assemblies 10 and 11, permitting the shells 12 and 25 of the assemblies to telescope until they are in fully telescoped relation as is seen in FIG. 2. By reason of the radially imposed clutching gripping thrust of the clutch ring areas 39, imposed on an arc of the perimeter of the shell 12 that is less than ½ the perimeter circumference, there is a transverse eccentric thrust imposed on the shell 12 which forces a large circumferential area opposite the clutch imposed thrust to cling firmly against the opposing surface within the wall of the shell 25 whereby not only is electrical contact assured between the shells through the tight engagement of the conductive metal clutch ring 33 with both of the shells, but by action of the clutch large areas of the shells 12 and 25 are maintained in thorough electrically contacting engagement. Inasmuch as there is no opening in the wall of the shell 25, radio frequency leakage is precluded.

At the point of maximum telescoped relationship of the shells 12 and 25, the clutch areas 39 snap at least partially into the groove 21, thereby providing a frictional interlock strongly resisting separation of the shells. Nevertheless, because of the characteristically rounded shoulder juncture of the shell 12 at the groove 21 and the substantially shallower depth of the cam wall means ringreceiving areas of the groove 21 than the wire cross section of the ring wire, camming and displacement of the clutching areas 39 from the groove 21 can be effected by applying sufficient relative separating pull on the shells. The interlock thus provided may be referred to as a strain separable interlock.

In another, and possibly simpler form of the generally C-shaped clutch ring, as shown in FIG. 6, the ring 33' is constructured of the same spring wire material as the ring 33 of FIG. 5. However, instead of a multi-shoulder and multi-clutch area out of round configuration, the clutch ring 33' has only one prominent clutch area 39' of preferably chordal shape across the ring opposite the gap between the split ends 35', with continuous arcuate shoulder areas 40' between the ends 35' and the junctures with the clutch area 39'. By having the overall diameter of the ring 33' slightly oversize relative to the groove 34, and the arcuate shoulder areas 40' on greater than 90° arcs, the shoulder areas 40' are retained in firm seated engagement within the clutch groove 34 by the inherent expansile tendency of the ring, with the clutch area 39' projecting adequately from the groove toward the axis of the socket shell within which the ring is assembled to effect the desirable clutching engagement with a coupled phonoreceptacle shell surface, and interlocking shoulder where the receptacle shell is provided with such a shoulder as for example by means of the groove 20 or 21'.

Where it is preferred to have the phonojack or receptacle shell formed as a turned metal member 12' as shown in FIG. 7, instead of being formed as a drawn sheet metal member as represented in the shell 12, the turned shell 12' may have a slightly thicker wall section provided with an internal shoulder 20' to receive the receptacle socket supporting insulation 13'. For strain separable clutch purposes, a groove 21' may be machined in the outer circumference of the shell 12'. Thereby when the phonoreceptacle of which the shell 12' is a component is telescoped within the phonoplug assembly 10, a strain separable clutching interlock of the clutching areas 39 or 39' will be effected in the groove 21'.

It will be appreciated that the phonoplug assembly 10 can be interchangeably used with phonoreceptacles of standard construction without the groove 21 or 21' if desired without the advantage of the strain separable clutching interlock. Nevertheless, the friction clutching action of the clutching areas 39 or 39' on the receptacle shell will serve to provide an efficient retaining clutching grip and electrical coupling, and effective to hold the assemblies against separation except if deliberately pulled apart with substantial force. On the other hand, the phonoreceptacle 11 may be employed with standard tulip finger equipped or other types of standard size phonoplug assemblies, because the indent groove 21 does not interfere with coaction of the shells of such standard phonoplug assemblies with which the receptacle assembly 11 may be coupled.

It will be understood that variations and modifications may be effected without departing from the spirit and scope of the novel concepts of this invention.

I claim as my invention:

1. A phonoconnector pin plug assembly for coupling with a phonoreceptacle and having an electrically conductive pin plug and an electrically conductive socket shell in electrically insulated concentric relation about the pin plug and with a phonoreceptacle receiving open mouth end directed in the same direction as said plug thereby to facilitate receiving the phonoreceptacle, comprising:

the socket shell being drawn from one piece of thin electrically conductive sheet metal and having a solid tubular wall with an inner substantially uniformly cylindrical diameter throughout a substantial length portion of the wall extending inwardly from said open mouth end to engage about a complementary cylindrical outside diameter of an electrically conductive phonoreceptacle shell received therein in free sliding fit throughout said length;

said socket shell wall being formed with a radially outwardly projecting annular bulge defining an annular inwardly opening groove in said inner diameter, and spaced a limited distance from said open mouth end so that there is a solid annular leadin length of said wall between said open mouth end and said groove and a substantial length of said wall extends from said groove inwardly for receiving the receptacle shell in said free sliding fit; and an electrically conductive spring wire resilient split out-of-round clutch ring firmly engaged within said groove and having clutching area of limited circumferential extent projecting generally radially inwardly from the groove and from said inner diameter of the socket shell wall for releasably retainingly engaging the receptacle shell;

said groove being at least as deep as the cross-sectional diameter of the wire of the clutch ring so that the clutch ring except for said clutching area is received in the groove free from interference with sliding reception of the receptacle shell into mated relation within the socket shell, and the clutching area is located on the ring to protrude from the groove sufficiently for, and in a manner to effect, transverse eccentric thrusting clutching engagement with the receptacle shell to force a large circumferential surface area of the receptacle shell, opposite from where thrust is imposed by said clutching area, into firm electrical as well as retaining contact with the engaged surface of the wall of the socket shell, the spring bias generated in the clutch spring by the thrusting engagement of said clutching area with the receptacle shell also assuring firm electrical engagement of the clutch ring with both of the shells.

2. An assembly according to claim 1, wherein said clutching area comprises a plurality of circumferentially spaced clutching area portions on said ring projecting inwardly relative to said socket shell wall to thrust against the receptacle shell, and all other portions of the ring engage the socket shell wall within said groove.

3. An assembly according to claim 1, wherein said ring is of generally C-shape having separated end portions and radially outwardly biased arcuate shoulder portions of substantial circumferential extent engaging within said groove, and a single clutching area portion located intermediate the shoulders.

4. A phonoconnector having a receptacle assembly provided with a substantial length electrically conductive cyndrical shell, and a phonoconnector pin plug assembly provided with a complementary socket shell within which the receptacle shell is slidably mated, the socket shell having a receiving opening mouth end directed in the same direction as the pin plug projects, and comprising:

the socket shell being drawn from one piece of thin electrically conductive sheet metal and having a solid tubular wall with an inner substantially uniformly cylindrical diameter throughout a substantial length portion of the wall extending inwardly from said open mouth end to engage about the complementary cylindrical outside diameter of the electrically conductive phonoreceptacle shell received therein in free sliding fit throughout said length;

said socket shell wall being formed with a radially outwardly projecting annular bulge defining an annular inwardly opening groove in said inner diameter, and spaced a limited distance from said open mouth end so that there is a solid annular leadin length of said wall between said open mouth end and said groove and a substantial length of said wall extends from said groove inwardly for receiving the receptacle shell in said free sliding fit; and and electrically conductive spring wire resilient split out-of-round clutch ring firmly engaged within said groove and having clutching area of limited circumferential extent projecting generally radially inwardly from the groove and from said inner diameter of the socket shell wall and releasably retainingly engaging the receptacle shell;

said groove being at least as deep as the cross-sectional diameter of the wire of the clutch ring so that the clutch ring except for said clutching area is received in the groove free from interference with sliding reception of the receptacle shell into mated relation within the socket shell, and the clutching area is located on the ring to protrude from the groove sufficiently for, and in a manner to effect, transverse eccentric thrusting clutching engagement with the receptacle shell to force a large circumferential surface area of the receptacle shell, opposite from where thrust is imposed by said clutching area, into firm electrical as well as retaining contact with the engaged surface of the wall of the socket shell, the spring bias generated in the clutch spring by the thrusting engagement of said clutching area with the receptacle shell also assuring firm electrical engagement of the clutch ring with both of the shells.

5. An assembly according to claim 4, wherein said clutching area comprises a plurality of circumferentially spaced clutching portions on said ring projecting inwardly relative to said socket shell wall and thrusting against the receptacle shell in such manner as to effect said eccentric forcing of the large circumferential surface area of the receptacle into firm electrical contact with the engaged surface of the wall of the socket shell.

6. An assembly according to claim 4, wherein said ring is of generally C-shape having separated end portions and radially outwardly biased arcuate shoulder portions of substantial circumferential extent engaging within said groove, and a single clutching area portion located intermediate the shoulders and thrusting eccentrically against the receptacle shell.

7. A phonoconnector according to claim 4, wherein said receptacle shell has fixed cam shoulder means thereon spaced from the end of the receptacle shell from which it enters the socket shell and complementary to the position of said groove and clutch ring when the receptacle shell is fully within the socket shell, said cam shoulder means being releasably engaged interlockingly by said clutching area and the ring being releasable from said cam shoulder means by axially pulling said receptacle assembly and pin plug assembly axially apart whereby the clutching area is cammed from the shoulder means to release the assemblies for axially sliding separation from one another.

8. A phonoconnector according to claim 7, wherein said receptacle shell has an annular groove depressed therein and having an oblique wall providing said shoulder means.

9. A phonoconnector according to claim 8, wherein said clutch ring is generally C-shape with the clutching area extending radially inwardly from said groove in said socket shell and releasably interlockingly engaged with said shoulder means and eccentrically thrusting said receptacle shell.

10. A phonoconnector comprising a receptacle assembly and a phonoconnector pin plug assembly, and wherein:

the receptacle assembly includes a substantial length cylindrical shell and the pin plug assembly includes a drawn one piece thin sheet metal tubular socket shell having a solid cylindrical wall complementary to the receptacle shell and receptive of the receptacle shell in sliding fit relation;

the socket shell being formed with a radially outwardly projecting annular bulge defining an inwardly opening annular groove therein and spaced a limited distance inwardly from a receiving end of said wall so that there is a solid annular leadin length of said wall between said groove and said end and a substantial length of said wall extends from said groove inwardly for receiving the receptacle shell slidably;

said receptacle shell having an outwardly opening, annular interlock groove which is aligned with the socket shell groove in the fully assembled relation of the shells with one another; and an electrically conductive spring wire resilient split out-of-round clutch ring firmly engaged within said socket groove and having clutching area of limited circumferential extent projecting generally radially inwardly from the socket groove and from the inner diameter of the socket shell wall and releasably retainingly engaging in said interlock groove;

said socket groove being at least as deep as the cross-sectional diameter of the wire of the clutch ring so that the clutch ring except for said clutching area is received in the groove free from interference with sliding reception of the receptacle shell into mated relation within the socket shell, and the clutching area is located on the ring to protrude from the socket groove sufficiently for, and in a manner to effect, transverse eccentric thrusting clutching engagement with the receptacle shell to force a large circumferential surface area of the receptacle shell opposite from where the thrust is imposed by said clutching area into firm electrical as well as retaining contact with the engaged surface of the wall of the socket shell, the spring bias generated in the clutch spring by the thrusting engagement of said clutching area with the receptacle shell also assuring firm electrical engagement of the clutch ring with both of the shells;

said interlock groove being shallower than the wire cross-sectional diameter of the split ring and having cam wall means whereby the shells can be separated by pulling them axially apart whereby the clutching area of the ring will be cammed out of the interlocking relation within said interlock groove.

11. A phonoconnector according to claim 10, wherein said clutching area comprises a plurality of circumferentially spaced clutching area portions on said ring projecting inwardly relative to said socket shell wall and engageable in said interlock groove at a plurality of circumferentially spaced points and thrust against the receptacle shell as aforesaid and all other portions of the ring engage within said interlock groove.

12. A phonoconnector according to claim 10, wherein said receptacle shell comprises a one piece drawn sheet metal member and said interlock groove comprises an indentation in said sheet metal receptacle shell.

13. A phonoconnector according to claim 10, wherein said receptacle shell comprises a machined part and said interlock groove is machined in the receptacle shell.

14. A phonoconnector according to claim 10, wherein said clutching area of the split clutch ring comprises a single projection from the socket shell groove opposite split ends of the ring.

* * * * *

UNITED STATES PATENT AND TRADEMARK OFFICE

CERTIFICATE OF CORRECTION

PATENT NO. : 4,072,386

DATED : February 7, 1978

INVENTOR(S) : William H. Wallo

It is certified that error appears in the above-identified patent and that said Letters Patent are hereby corrected as shown below:

Column 4, line 8, for "portion" read --portions--;

line 41, for "peak" read --peaks--;

line 60, for "a" read --,--.

Column 5, line 43, for "ringreceiving" read --ring-receiving--.

Column 7, line 37, for "cyndrical" read --cylindrical--.

Signed and Sealed this

*Thirteenth* Day of *February 1979*

[SEAL]

*Attest:*

RUTH C. MASON
*Attesting Officer*

DONALD W. BANNER
*Commissioner of Patents and Trademarks*